United States Patent [19]

Nishimura

[11] 4,312,056

[45] Jan. 19, 1982

[54] COMPOSITE DISPLAY TYPE ELECTRONIC TIMEPIECE

[75] Inventor: Katsuo Nishimura, Tokorozawa, Japan

[73] Assignee: Citizen Watch Company Limited, Tokyo, Japan

[21] Appl. No.: 110,309

[22] Filed: Jan. 8, 1980

[30] Foreign Application Priority Data

| | | | |
|---|---|---|---|
| Jan. 17, 1979 | [JP] | Japan | 54-4254 |
| Jan. 17, 1979 | [JP] | Japan | 54-4257 |
| May 11, 1979 | [JP] | Japan | 54-56973 |
| Aug. 31, 1979 | [JP] | Japan | 54-111299 |

[51] Int. Cl.[3] ..... G04B 19/22; G04B 19/24; G04B 19/04

[52] U.S. Cl. ..... 368/62; 368/21; 368/28; 368/80; 368/84

[58] Field of Search ..... 368/21-23, 368/28-30, 69, 71, 79, 80-84, 239-242

[56] References Cited

U.S. PATENT DOCUMENTS

| | | | |
|---|---|---|---|
| 2,542,021 | 2/1951 | Fox | 368/82 |
| 3,911,665 | 10/1975 | van Berkum | 368/80 |
| 4,026,103 | 5/1977 | Ichikawa et al. | 368/84 |
| 4,084,404 | 4/1978 | Wiget | 368/84 |
| 4,218,872 | 8/1980 | Ikegami | 368/29 |

*Primary Examiner*—Vit W. Miska

*Attorney, Agent, or Firm*—Jordan and Hamburg

[57] ABSTRACT

An electronic timepiece having a compound display comprising an electro-optical display portion and an analog display portion having time indicating hands and a dial, with the electro-optical display portion being provided by an electro-optical display cell having a central aperture in which at least a portion of the movement of the analog display portion and the analog display dial are accommodated. Information such as seconds indication is provided peripherally around the analog display portion by the electro-optical display portion.

10 Claims, 32 Drawing Figures

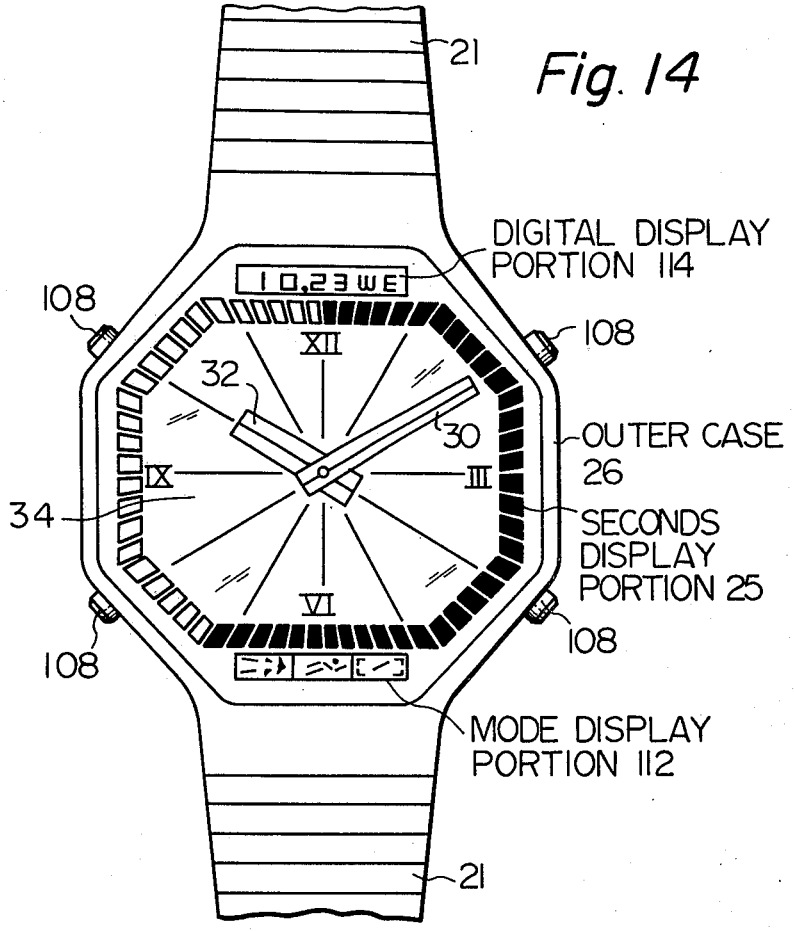
Fig. 14
Fig. 15
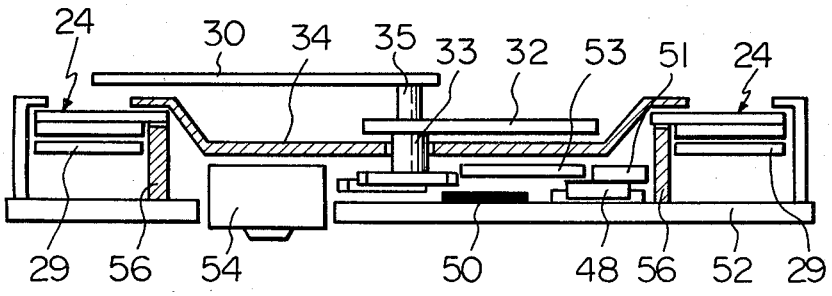

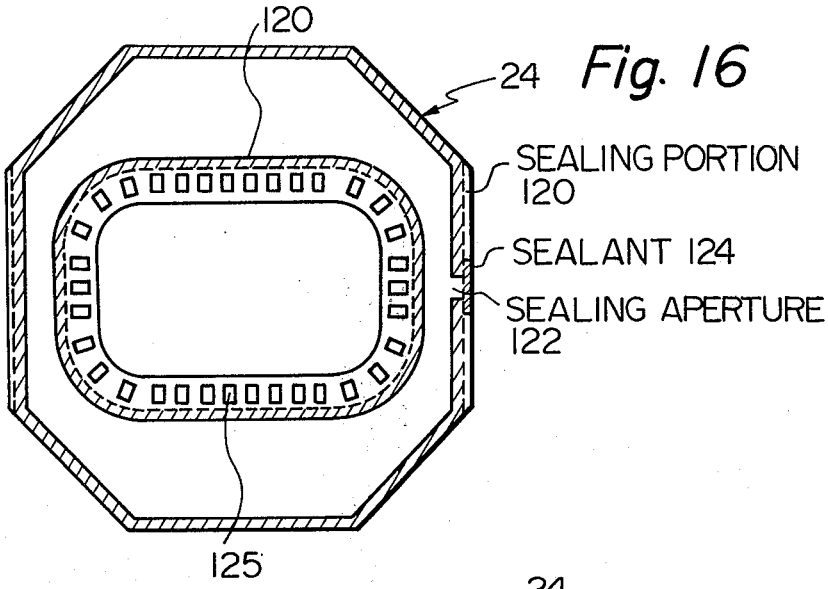
Fig. 16
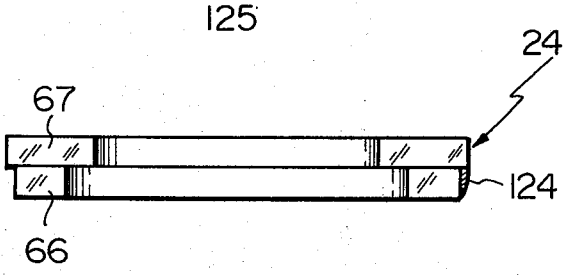
Fig. 17
Fig. 18
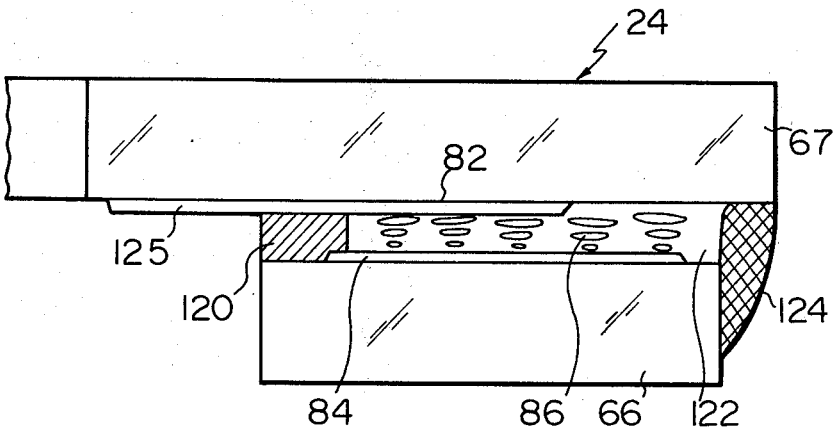

Fig. 20
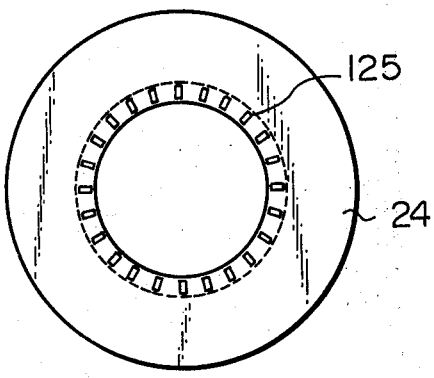
Fig. 21
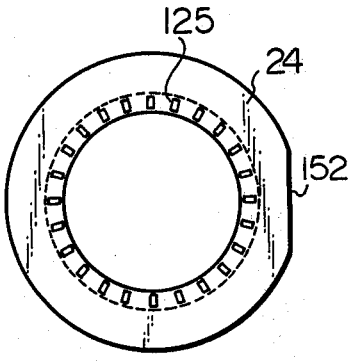
Fig. 22
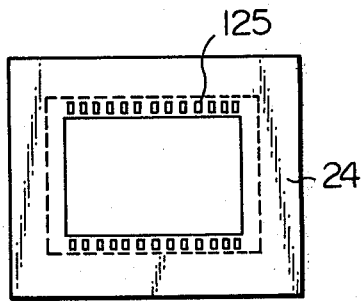
Fig. 23
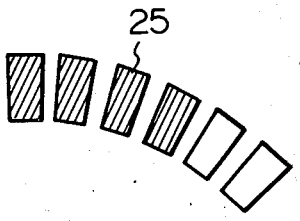
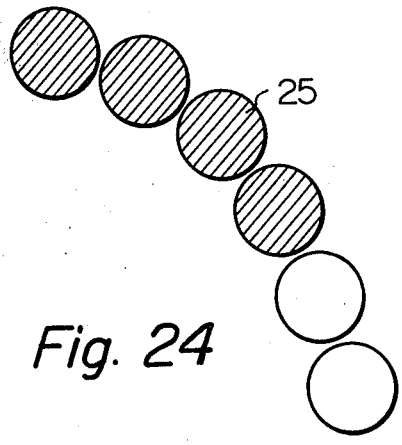
Fig. 24

25
EC
USA
NYC
CHI
LAX
154
India
MASKING PLATE 36
JAPAN
HKG
ZONE NAME/SECONDS
DISPLAY SELECTION
SWITCH 131
AM 5:09PR
114

25
0
12
45
9
3
15
6
30

COMPOSITE DISPLAY TYPE ELECTRONIC TIMEPIECE

BACKGROUND OF THE INVENTION

Various electronic timepieces have recently been introduced in which both an analog display portion, composed of time indicating hands and a dial, and an electro-optical display portion are combined, to form a compound type of display. The electro-optical display portion may indicate, for example, current time information in digital form, data information, etc. The analog display portion indicates hours, minutes and in some cases also seconds information, as in the case of a conventional timepiece. Such a compound display presents the advantages of a novel and attractive appearance. In addition, while a digital display of time information is generally easier to read to a high degree of accuracy, most people are more familiar with the conventional type of analog display, so that a compound display has advantages in terms of sales appeal.

In the previous embodiments of such timepieces with compound displays which have been produced, the degree of harmonization between the electro-optical and the analog display portions leaves much to be desired. As will be shown in the subsequent descriptions of such prior art embodiments, the correllation between the shape of the digital display portion and that of the analog display portion does not provide the maximum degree of overall attractiveness, with the digital display portion being generally disposed as a rectangular or lozenge-shaped module within or adjacent to the analog display portion. Since the electro-optical display cell must in this case necessarily be of small dimensions, such an arrangement also has the disadvantage that the number if connections which can be made to the electro-optical display cell, and the ease of making these connections, is low.

In an electronic timepiece according to the present invention, these disadvantages of the prior art embodiments are overcome by utilizing an electro-optical display cell having a central aperture, with the analog display portion being provided within that aperture. In other words, the electro-optical display cell is in the form of a frame, the general form of which may be annular, square, etc., which surrounds the dial and time indicating hands of the analog display portion. Since the shape of the electro-optical display portion and the analog display portion can thus be harmonized, while a large number of connections can easily be provided to the electro-optical display cell, the present invention enables an electronic timepiece having a compound analog and digital display of highly advantageous design to be produced.

SUMMARY OF THE INVENTION

The present invention comprises an electronic wristwatch having a compound display, comprising an electro-optical display portion formed of an electro-optical display cell in the form of a frame around a central aperture, and an analog display portion formed of a dial and time indicating hands, with all or at least the major part of the analog display portion, and a movement for driving the analog display portion, being disposed within the central aperture in the electro-optical display portion. The electro-optical display portion may indicate information in digital form, or can have a plurality of display elements successively disposed around the periphery of the analog display portion, for indicating seconds information, by successive activation of these display elements, or for indicating elapsed time information. The electro-optical display cell is supported, around at least one of its outer and inner peripheries, by a flexible member having conductive regions formed in it, for thereby providing both mechanical support and shock protection and also electrical connection to the display elements of the liquid crystal cell. The structure of the compound display is such that these connections to the electro-optical display cell are concealed in a simple and unobtrusive manner. Since it is possible with the present invention to accommodate at least a part of the movement which drives the analog display portion within the thickness of the electro-optical display cell, and to arrange that the plane of rotation of the time indicating hands is aligned with the upper surface of the electro-optical display cell, the present invention also enables an electronic timepiece having a compound display to be produced which is substantially thinner than has been possible with prior art timepieces having a compound type of display.

BRIEF DESCRIPTION OF THE DRAWINGS

In the appended drawings,

FIG. 14 is an external view of a third embodiment of an electronic timepiece according to the present invention;

FIG. 15 is a cross-sectional view of the embodiment of FIG. 14;

FIG. 16 and FIG. 17 are plan and cross-sectional views respectively of a liquid crystal display cell used in the embodiment of FIG. 16;

FIG. 18 is a cross-sectional view illustrating in detail a portion of the liquid crystal cell of FIG. 16 and FIG. 17;

FIGS. 20, 21 and 22 are plan views illustrating further configurations of liquid crystal display cells for an electronic timepiece in accordance with the present invention;

FIG. 23 and FIG. 24 illustrate possible configurations of display elements for indicating seconds information, in a liquid crystal display cell according to the present invention;

DESCRIPTION OF THE PREFERRED EMBODIMENTS

Figure 1:
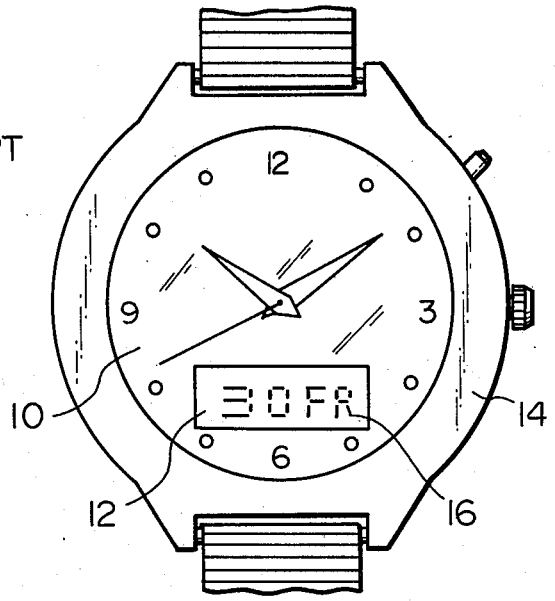
Fig. 1 PRIOR ART
FIG. 1 shows an example of a prior art embodiment of an electronic timepiece having a compound display.

Referring now to the drawings, FIG. 1 is an external view of a first example of an electronic timepiece known in the prior art, having a combination of a liquid crystal display cell and an analog display portion In this example, a window 12 is provided in a dial plate 10, and a digital display provided by a liquid crystal display cell 16 appears through window 12.

Figure 2:
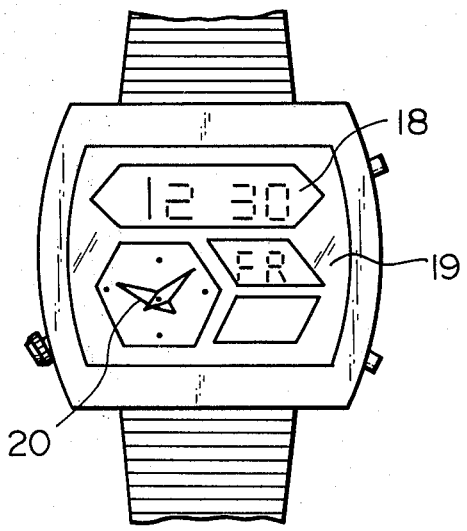
Fig. 2 PRIOR ART
FIG. 2 shows another example of a prior art embodiment of an electronic timepiece having a compound display.
Figure 3:
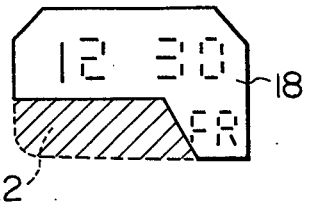
Fig. 3 PRIOR ART
FIG. 3 illustrates the form of the liquid crystal display cell used in the prior art embodiment of FIG. 2.

FIG. 2 illustrates another prior art example of an electronic timepiece having a compound display composed of a liquid crystal display cell and analog display portion. Here, a liquid crystal display cell 18 having the configuration shown in FIG. 3 is positioned behind a window in a masking plate 19. Analog time information is provided by an analog module 20, which is arranged to fit within a recess 22 provided in liquid crystal display cell 18. Such a timepiece provides a more attractive appearance than that of FIG. 1, but a completely harmonious correlation between the analog display portion and the liquid crystal display portion is not fully attained.

Figure 4:
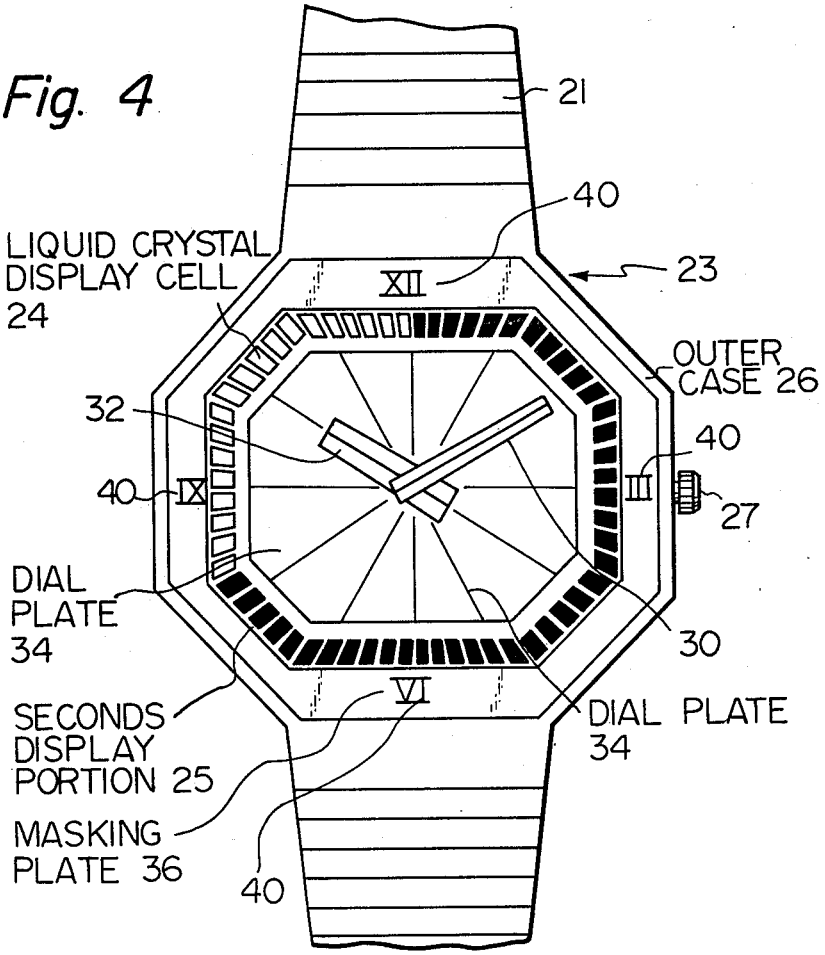
FIG. 4 is an external view of a first embodiment of an electronic timepiece according to the present invention.

Referring now to FIG. 4, a first embodiment of an electronic timepiece according to the present invention is shown. Reference numeral 21 denotes a watchband, numeral 26 the outer case, and numeral 27 a switch in the form of a timepiece crown. An analog display portion is composed of time indicating hands 30 and 32 and a dial plate 34. An electro-optical display cell 24 has a set of display elements arranged to cumulatively display seconds information, constituting a seconds display portion 25.

Figure 5:
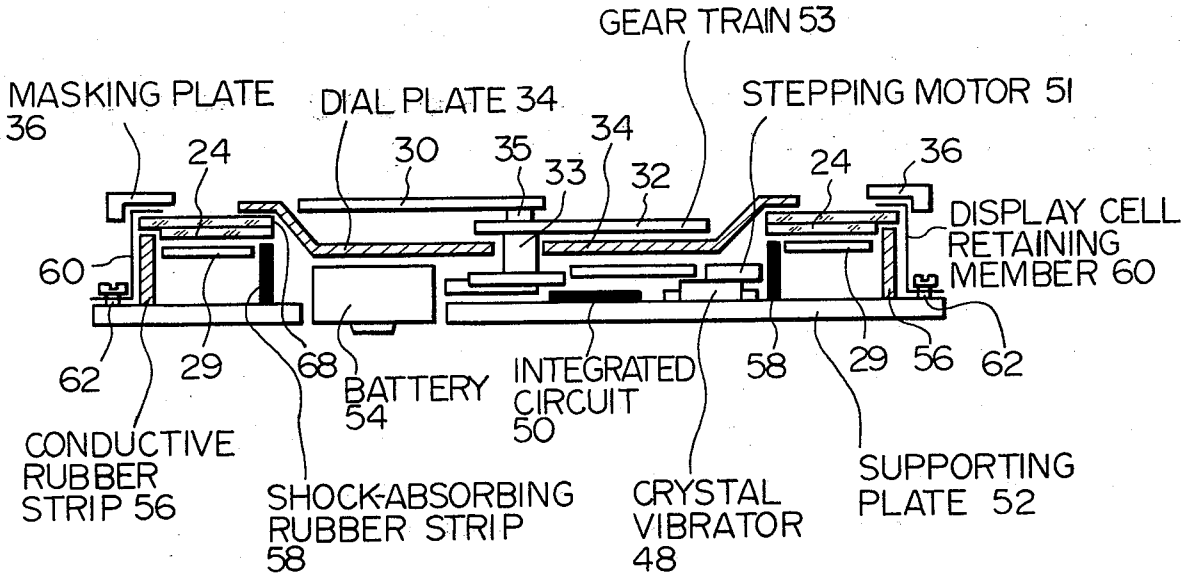
FIG. 5 is a partial cross-sectional view illustrating the principal components of the embodiment of FIG. 4.

FIG. 5 is a simplified cross-sectional diagram of the timepiece of FIG. 4, in which the major components are shown as mounted on a supporting plate 52. Power is provided by a battery 54. The electro-optical display cell comprises a liquid crystal display cell retained by retaining member 60, and electrical connections to the electrodes of liquid crystal display cell 24 are established by means of a flexible supporting member 56 which serves as a supporting and shock-absorbing member as well as a connector. Member 56 can comprise a strip of rubber material having appropriate electrical conducting regions formed in it, and such a member will be referred to subsequently in this specification and the appended claims as a conductive rubber strip, for brevity of description. Another rubber strip, which in this embodiment is electrically non-conductive, performs a supporting and shock-absorbing function around the inner periphery of the liquid crystal display cell 24, and is denoted by numeral 58.

A masking plate 36 is mounted peripherally around the liquid crystal display cell 24, to conceal the conductive rubber strip 56 and retaining member 60. Masking plate 36 may be provided with a decorative pattern, or can have time indicating numerals printed thereon, as indicated by reference numeral 40 in FIG. 4. Time indicating hands 30 and 32 are driven by shafts 35 and 33 coupled through a gear train 53 to a stepping motor 51. Drive signals for stepping motor 51 are produced by an integrated circuit 50 coupled to a quartz crystal vibrator 48. Drive signals for the seconds display portion 25 of liquid crystal display cell 24 are also produced by integrated circuit 50.

As shown in FIG. 5, dial plate 34 is formed such that a major portion thereof is positioned within the central aperture 68 in liquid crystal display cell 24, while a rim portion of dial plate 34 extends over the junction between shock-absorbing rubber strip 58 and liquid crystal display cell 24, thereby concealing the junction between the shock-absorbing rubber strip 58 and liquid crystal display cell 24.

The dish-shaped configuration of dial plate 34 permits the level of the outermost time indicating hand 30 to be positioned substantially in the same plane as the uppermost surface of liquid crystal display cell 24.

Figure 6B:
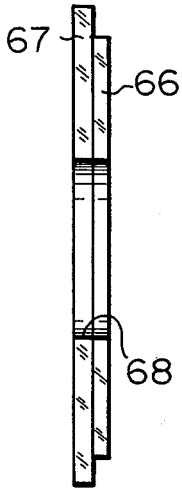
FIG. 6A and FIG. 6B are plan and cross-sectional views respectively of a liquid crystal display cell used in the embodiment of FIG. 4.
Figure 6A:
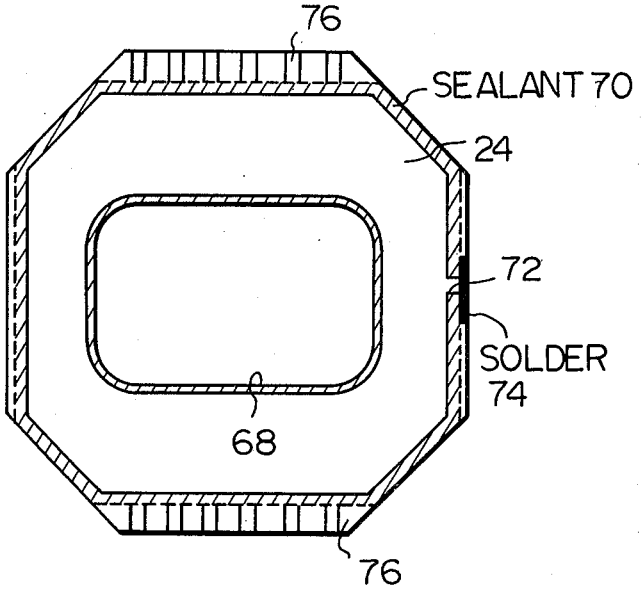

FIGS. 6A and 6B are plan and cross-sectional views of liquid crystal display cell 24. Numeral 68 denotes a central aperture. The cell is formed of upper and lower glass substrates 67 and 66. These are connected by a sealing portion 70, comprising low melting-point glass. An aperture 72 is provided to allow entry of the liquid crystal material, and this is sealed by means of solder, as indicated by numeral 74, after the liquid crystal material has been inserted. Connections to the cell electrodes are provided by connection areas 76 formed on portions of the lower surface of upper glass substrate 67.

Figure 7:
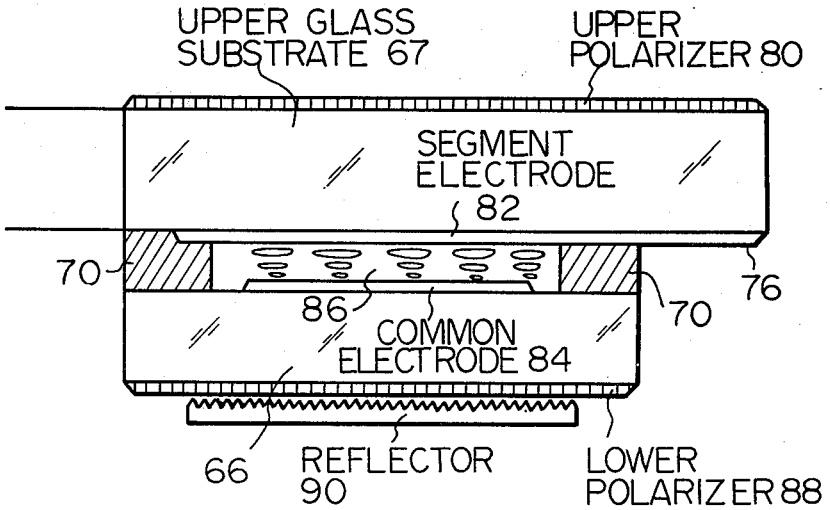
FIG. 7 is a cross-sectional view illustrating a portion of the liquid crystal display cell of FIGS. 6A and 6B.

FIG. 7 shows a portion of the liquid crystal display cell 24 in greater detail. An upper polarizer 80 comprises a layer which is bonded to the top surface of upper glass substrate 67. A lower polarizer 88 is bonded to the lower surface of lower glass substrate 66, and a reflector 90 is positioned below lower polarizer 88. A common electrode 84 is formed on the upper surface of lower glass substrate 66, while segment electrodes 82 are formed on the lower surface of upper glass substrate 67, to define the various display elements of seconds display portion 25. The segment electrodes 82 are formed of a transparent, electrically conductive thin film of material such as tin oxide ($SnO_2$), or indium oxide ($In_2O_3$). Portions of the segment electrodes 82 extend out onto connecting area 76, for connection purposes. Although not shown, alignment layers are formed on the inner surfaces of upper glass substrate 67 and lower glass substrate 66, acting in directions at right angles to one another, and composed of silicon oxide formed by slant evaporative deposition or by rubbing.

Sealing portion 70 has a thickness of approximately 8 microns, and is formed of low-melting point glass powder made into a paste, and applied by a screen printing process. The upper and lower glass substrates are then placed in contact, and the sealing portion is fused at a temperature of the order of 500° C.

Numeral 86 denotes a P-type liquid crystal material, which forms a twisted nematic layer. The axes of polarization of the upper and lower polarizers 80 and 88 are at right angles to one another. Reflector 90 provides a diffuse reflecting surface.

Numerals and graduations for indicating time information can be be provided either on dial plate 34 or on masking plate 36, or upon both. In this embodiment, seconds information are successively displayed by the display elements of seconds display portion 25 in a cumulative manner, in an analog rather than in a digital display configuration.

Figure 8:
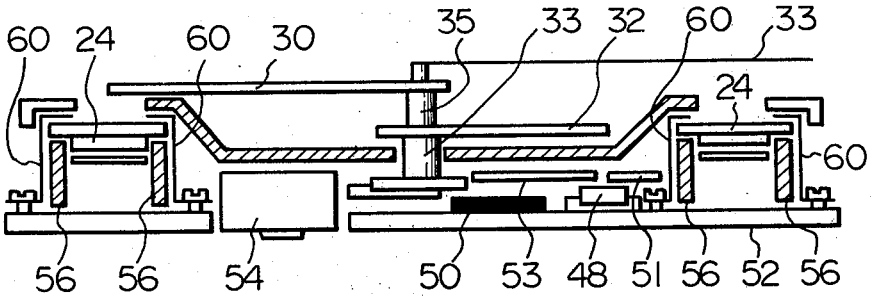
FIG. 8 is a cross-sectional view of a modification of the embodiment of FIG. 5.

A second embodiment of the present invention will now be described. Referring first to FIG. 8, a liquid crystal display cell 24 is held in position by retaining members 60, mounted on a supporting plate 52. Electrical connection from an integrated circuit 50 to liquid crystal display cell 24 is provided by means of two conductive rubber strips 56 positioned around the inner and outer peripheries of liquid crystal display cell 24. The assemblage of components by which time indicating hands 30 and 32 (as well as liquid crystal display cell 24) are driven, i.e. battery 54, integrated circuit 50 with crystal vibratoar 48, stepping motor 51, gear train 53, and shafts 34 and 35, with dial plate 34, will be collectively referred to hereinafter in the specification and appended claims as an innner module, for brevity of description. In this embodiment, the major portion of this inner module is accommodated within the central aperture in liquid crystal display cell 24. In this embodiment, seconds information is indicated by a seconds hand 33.

Figure 9B:
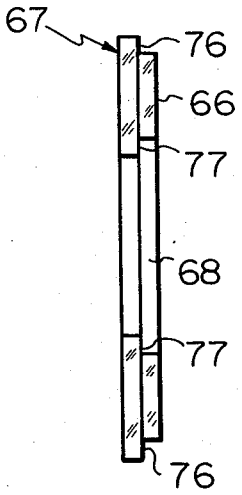
FIGS. 9A and 9B are plan and cross-sectional views respectively of a liquid crystal display cell which is a modification of the liquid crystal display cell shown in FIGS. 6A and 6B.
Figure 9A:
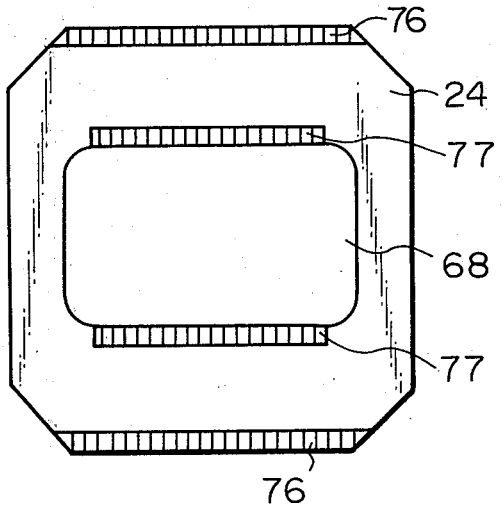

FIG. 9A and 9B show plan and cross-sectional views of a modification of the liquid crystal display cell 24 shown in FIG. 6A and 6B, applicable to the embodiment of FIG. 8, in which connecting areas 77 and 76 are provided both at the inner and outer peripheries of the cell. This modification enables a greater number of connections to be established with the conductive rubber strips 56, so that a greater number of functions may be performed by liquid crystal display cell 24 than in the case when connecting area 76 is provided only at the outer periphery of upper glass substrate 67.

Figure 10:
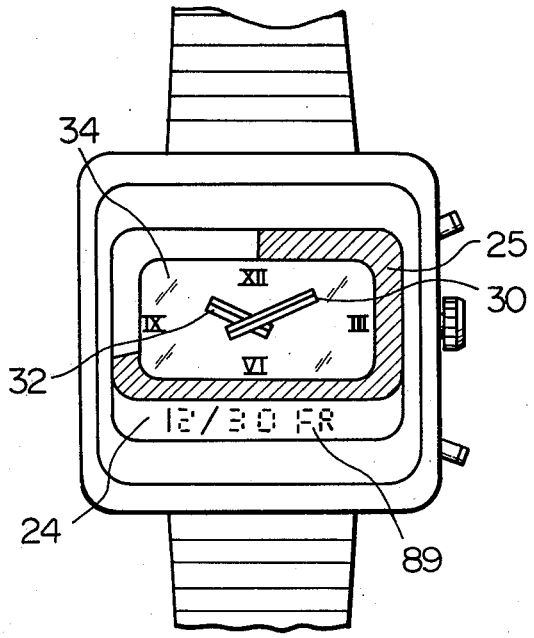
FIG. 10 is an external view of a second embodiment of an electronic timepiece according to the present invention.

FIG. 10 is a external view of another embodiment of the present invention. In this embodiment, the liquid crystal display cell 24 provides a digital display of date information, as indicated by numeral 89, in addition to a cumulative display of seconds information by a seconds display portion 25, as in the previous embodiments. Analog time information is indicated by hands 30 and 32 with dial plate 34.

Figure 11:
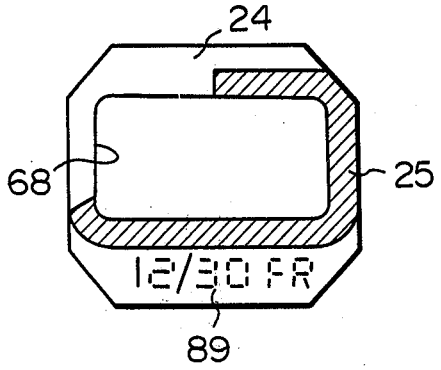
FIG. 11 is a plan view illustrating a liquid crystal display cell used in the embodiment of FIG. 10.

The configuration of the liquid crystal display cell 24 in this embodiment is shown in FIG. 11. As in the previous embodiments, the liquid crystal display cell 24 is composed to two glass substrates, each having an aperture therein, so that the completed liquid crystal display cell 24 has a central aperture 68 to accommodate an inner module. It should be noted that the glass substrates of this and the other embodiments of the present invention may be formed by diamond drilling, etching, liquid horning grinding or other techniques, and that it is also possible to utilize plastic sheet as the substrates of liquid crystal display cell 24, rather than glass.

Figure 12:
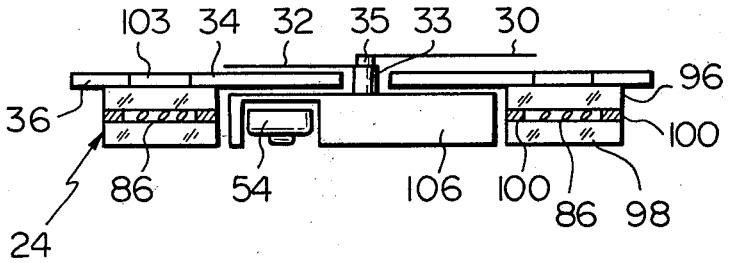
FIG. 12 is a cross-sectional view of the embodiment FIG. 10.

FIG. 12 is a cross-sectional view of this embodiment in which it can be seen that the thickness of the inner module 106, including the battery 54, is almost equal to that of the liquid crystal display cell 24. The dial plate 34 and masking plate 36 lie in the same plane, and may be formed integrally from a single sheet of material. The liquid crystal display cell 24 is made up of upper glass substrate 96 and lower glass substrate 98, with liquid crystal material 86 sandwiched between them, sealed peripherally by sealing areas 100.

As shown by the embodiment of FIGS. 10 to 11, the present invention enables an electronic timepiece to be produced of very low thickness, having a compound digital and analog display, and of highly attractive appearance. It will be appreciated that each category of information, i.e. date, seconds and hours and minutes information, is presented in the most legible and convenient form, while the basic construction of the timepiece is simple and easily manufactured.

Figure 13:
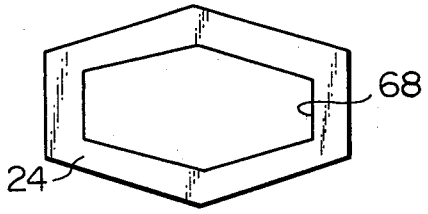
FIG. 13 illustrates a modification of the liquid crystal display cell shown in FIG. 11.

FIG. 13 illustrates another possible shape for a liquid crystal display cell to be used in a timepiece according to the present invention, which in this case is of hexagonal outline.

A third embodiment of the present invention will now be described, referring first to FIG. 14 which is an external view thereof. Here, analog time information is indicated by hands 30 and 32 with dial plate 34. Seconds information is cumulatively displayed by a seconds display portion 25 comprising display elements of a liquid crystal display cell 24. Date information is indicated by a digital display portion 114 of liquid crystal display cell 24 while, operating mode information is indicated by a mode display portion 112 of liquid crystal display cell 24. Indicated at 108 are setting switches and mode selection switches.

FIG. 15 shows a cross sectional view of the wristwatch of FIG. 14. The wristwatch is shown as having a long hand 30, a short hand 32, a long hand shaft 35, a short hand shaft 33, a gear train 53, a reversible stepping motor 51, a quartz crystal vibrator 48, a timekeeping integrated circuit 50, a supporting plate serving as a circuit board 52, a silver battery 54, and a strip of electrically conductive rubber 56 for electrical connection. The display portion comprises a ring-shaped liquid crystal display cell 24, a dial 34, a reflector 29, as well as the long and short hands 30, 32.

The ring-shaped liquid crystal display cell 24, as shown in FIG. 16, includes a sealing portion 120 comprising glass of a low melting point, a sealing aperture 122 forming an opening through which a liquid crystal material is injected, a sealant 124 where the opening is to be sealed by solder, and a portion 125 for providing a connection to associated circuitry.

Shown in FIG. 17 is a cross-sectional view of the ring-shaped liquid crystal display cell, including an upper ring-shaped glass plate 67 and a lower ring-shaped glass plate 66.

Shown in FIG. 18 is the upper ring-shaped glass plate 67 having a segment electrode 82 formed on its lower surface, the electrode comprising a transparent, electrically conductive thin film of tin oxide ($SnO_2$) or indium oxide ($In_2O_3$), wherein the exposed portion of the electrode is the portion 125 that provides the connection to the associated circuitry. Formed on the upper surface of lower glass plate 66 is a common electrode 84 similarly comprising a transparent electrically conductive thin film. Although not shown, an alignment layer is formed on the opposing surfaces of the upper and lower glass plates 67, 66, namely on that side of each glass plate having the electrodes, the alignment layers being arranged at a right-angle to each other and consisting of silicon oxide (SiO) formed by a technique such as slant evaporation or lapping. The sealing portion 120 has a thickness of approximately 10μ and consists of glass powder of a low melting point which is rendered into the form of a paste and then applied by a screen printing process, after which the two glass plates are stacked. Calcination at a temperature of approximately 500° C. forms the sealing portion. A P-type liquid crystal material whose molecules are dielectrically positive is then injected into the space between the glass plates to form a twisted nematic liquid crystal layer 86. Prior to injection of the liquid crystal material, a thin film is formed by slant evaporation on the peripheral portion of the sealing aperture 122, the film consisting of chromium (Cr) and palladium (Pd), or chromium (Cr), nickel (Ni) and silver (Ag). Following injection of the liquid crystal the sealing aperture is sealed with solder to form a soldered seal portion or sealant 124. An upper linear polarizer is disposed above the upper glass plate 67 and a lower linear polarizer below the lower glass plate 66, and the polarizers are arranged such that their axes of polarization cross each other at a right-angle. The polarizers are not shown in FIGS. 17 and 18.

Figure 19:
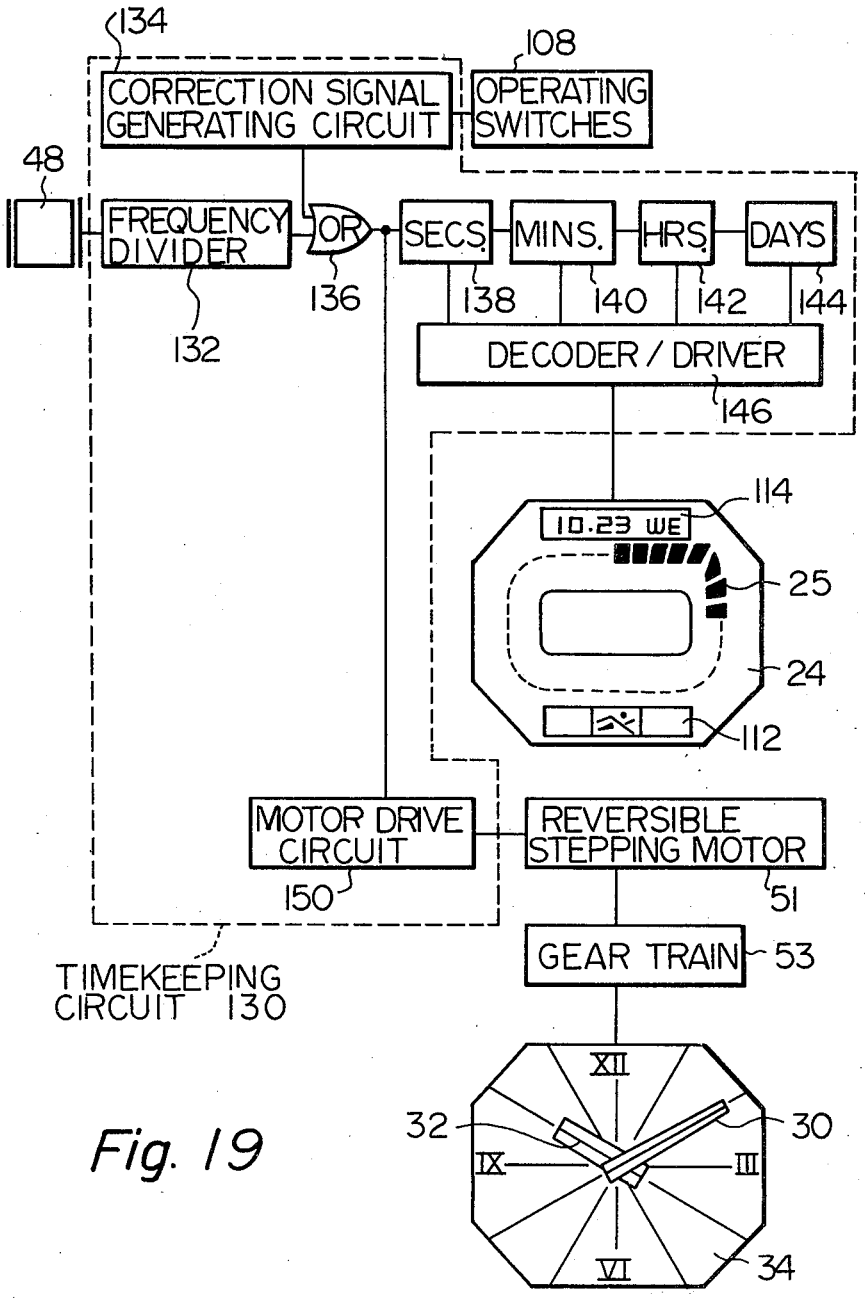
FIG. 19 is a block diagram of the embodiment of FIG. 14.

Included in the circuit block diagram of FIG. 19 is a timekeeping integrated circuit 130 enclosed by the dotted line, the circuit incorporating an oscillator 48 and frequency divider 132, a correction signal generating circuit 134, an OR gate 136, a seconds counter 138, minutes counter 140, hours counter 142, dates counter 144, a decoder/driver 146 arranged to provide drive signals which are applied to the display cell 24 to provide a display of seconds information by segments 25, dates information by digital display portion 114, and mode information by display section 112, and a motor drive circuit 150 which drives a reversible stepping motor 51. The stepping motor 51 is connected through gear train 53 to drive an analog display portion composed of hands 32 and 30.

Quartz crystal oscillator 48 oscillates at a frequency of approximately 32 KHz and serves as a generator which provides a time base signal. The frequency divider 132 divides the 32 KHz frequency down to frequencies of 16 KHz, 8 KHz, . . . 4 KHz, 2 KHz and 1 KHz. Seconds signals are counted by seconds counter 138, minutes signals by minutes counter 140, hours signals by hours counter 142, and day of the week, date and months signals by dates counter 144. Decoder/-driver 146 responds to these signals to produce a liquid crystal display drive signal that drives a seven segment numerical display 114 and a 60-segment circumferential display 25, whereby the ring-shaped liquid crystal display cell 24 is driven to display time, date, day of the week, etc. The motor drive circuit 150 generates stepping motor drive signals for advancing the analog display at a rate of once every ten seconds or once per minute. Thus, reversible stepping motor 51 is driven by the drive circuit 150, and gear train 53 functions as a speed reduction and transmission mechanism to rotate the long and short hands 30, 32 which indicate minutes and hours, respectively. Depressing push-button 108 causes correction signal generating circuit 134 to issue a correction signal which effects a correction of the time, date, etc. by correcting motor drive circuit 150, seconds counter 138, minutes counter 140, hours counter 142 and dates counter 144. It is possible to adopt an arrangement in which the ring-shaped liquid crystal display cell and the long and short hands 30, 32 are corrected simultaneously or individually.

Since the portion 125 for the connection to the associated circuitry is provided on the inner side of the ring-shaped liquid crystal display cell 24, the strip of electrically conductive rubber 56 is also disposed on the inner side in order to effect the connection to the circuit board 52. The connection portion is covered effectively with the dial 34 which has graduations that permit the time indicated by the long and short hands 30, 32 to be read. In particular, forming the sealing portion 120 of a glass powder having a low melting point allows its width to be reduced to 0.5 mm or less. This permits the effective display surface to be widened fully up to the outer circumferential portion of the ring-shaped display cell, and enables an improvement in the compatibility and harmony of the analog and liquid crystal display portions. The injection of the liquid crystal material and the provision of the soldered seal is facilitated, as well as the evaporation step prior to the solder sealing step, by locating the sealing aperture 122 on the outer side of the ring-shaped configuration.

The ring-shaped liquid crystal display cell 24 has a ring-shaped seconds display portion 25 consisting of display elements each of which is adapted to display one second of time, allowing the passage of time in seconds to be displayed integrally in an analog manner. The display of months, date, day of the week, dual time (separate from the analog display) and a chronograph is effected by an alpha-numeric display portion constituting digital display portion 114 composed of display segments. A mode mark display portion 112 displays an alarm mark, a chronograph mark, a timer mark, etc., and therefore indicates which of a plurality of functions has been selected.

FIGS. 20, 21 and 22 show various modifications of the ring-shaped liquid crystal display cell 24. In FIG. 20 the cell has a ring-shaped configuration with perfectly circular inner and outer circumferences, the connection portion 125 also being disposed in a circumferential manner. The cell shown in FIG. 21 is almost the same as the arrangement of FIG. 20 except for the fact that a datum level 152 is provided for manufacturing purposes. In FIG. 22 the cell has a ring-shaped configuration with rectangular inner and outer circumferences. Various other ring-shaped cell configurations may be possible, such as one having elliptical inner and outer circumferences.

Thus, in a dual display wristwatch of the type which has a power source such as a silver or lithium battery, an element such as a quartz crystal oscillator for supplying a time base, an integrated circuit for timekeeping purposes, frequency divider circuit, counter circuit and driver circuit, etc., an electromechanical transducer such as a stepping motor, time-indicating hands which move in conjunction with the transducer, a dial, and a liquid crystal display cell, the hands and liquid crystal display cell cooperating to display a variety of horological information such as the time date and day of the week, etc., the liquid crystal display cell is rendered into a ring-shaped configuration, and a portion for providing the connection to the integrated circuit is disposed on the inner side of the ring-shaped liquid crystal display cell, thereby making possible a thinner, multi-function timepiece having combined analog and digital displays, the timepiece featuring a wide display extending fully up to the outer circumferential portion of the display cell, as well as improved compatibility and harmony between the analog and digital displays. In addition, providing the connection portion on the inner side of the ring-shaped display cell and the sealing aperture for injection of liquid crystal material on the outer side thereof facilitates an evaporation step prior to a solder sealing step, and also facilitates the injection of the liquid crystal material as well as the solder sealing step.

A slim and commercially valuable timepiece having combined analog and digital displays can be realized by accommodating all or a portion of such components as an electromechanical transducer, such as a stepping motor, a gear train which moves in conjunction with the transducer, time-indicating hands and their supporting shafts and a dial, in a portion bounded by the inner circumference of the ring-shaped liquid crystal display cell. The time-indicating hands include long and short hands for indicating minutes and hours, and the liquid crystal display cell is provided with a seconds display portion arrayed in the form of a ring and adapted to display seconds information in such a manner that the passage of time in seconds can be displayed integrally. Moreover, electrically switching the seconds display elements allows them to be utilized in displaying other information, such as in designating world time regions or in displaying te amount of time which remains left when a timer mode is selected.

FIGS. 23 and 24 show modifications of seconds date display portion 25. The display elements in FIG. 23 are substantially oblong and those in FIG. 24 are circular.

Figure 25:
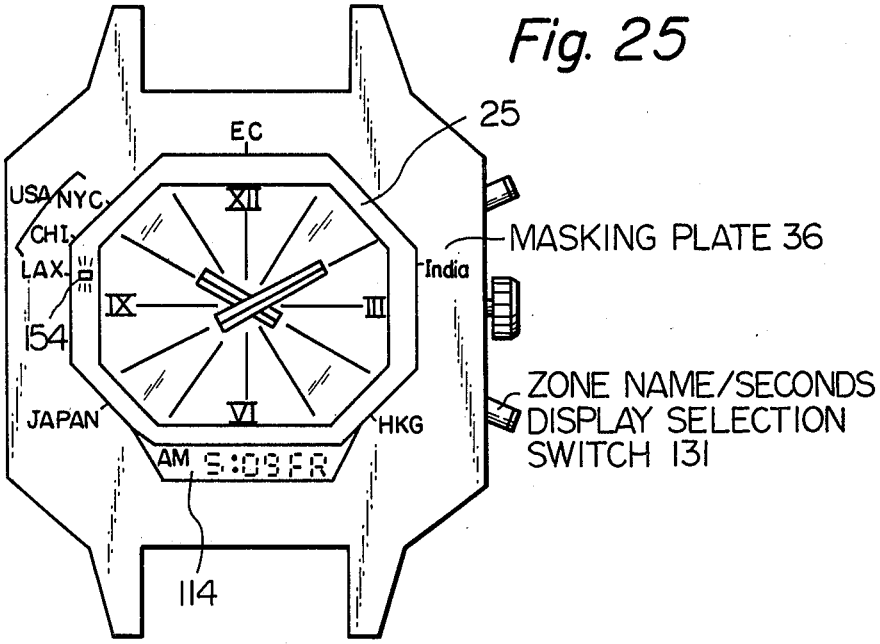
FIG. 25 illustrates a fourth embodiment of an electronic timepiece according to the present invention, in which time zone information is provided in the liquid crystal display portion.

Referring to FIG. 25, there is shown a modification of the electronic timepiece to the present invention. This timepiece includes an electro-optical display portion 25 operable to selectively indicate seconds and time zone, country name and place concerning world time. A digital display portion 114 cooperates with the display portion 25 to provide a display of hours, minutes and days of week in a designated country or city. A masking plate 36 is provided with symbols such as "JAPAN", "USA" and like country names, "EC" and like zone names, "NYC (New York City)" and like 3-letter codes etc. The display portion 25 usually displays seconds in the manner as discussed in the previous embodiments. When a zone name/seconds display selection switch 131 is manipulated to select a world time mode, an indication of a selected position flickers as at 154. In Fig. 25, "LAX (Los Angeles)" in "USA" has been designated while the digital display 114 displays "5.09 AM, Friday (FR)".

Figure 26:
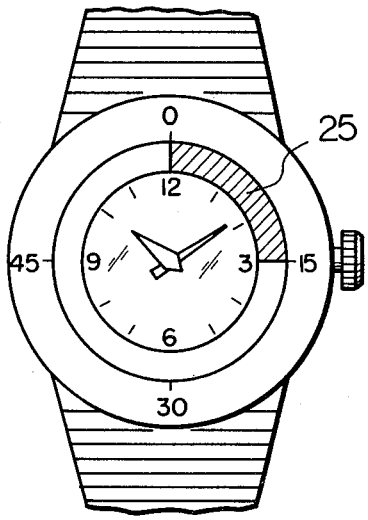
FIG. 26 is an external view of a fifth embodiment of an electronic timepiece according to the present invention, in which "time remaining" information is indicated by the liquid crystal display portion.

FIG. 26 depicts a farther modification of the invention in which each of seconds is usually indicated by one dot but, when a remaining time display mode is selected, the remaining time is displayed by a series of continuous dots. The watch in FIG. 26 is shown as displaying 15 minutes left.

In summary, in a compound display wrist watch equipped with both of hands and a liquid crystal display device, a wristwatch according to the invention indicates hours and minutes by hands and seconds by a liquid crystal display device in an analog fashion. Thus, the hand portion and liquid crystal display device can be well matched overcoming the difficulty heretofore experienced and, additionally, the analog display of seconds by liquid crystal presents the passage of time in a novel mode. It will therefore be appreciated that a compound display wristwatch of the invention has an outstanding commercial value.

More improved matching between the hand portion and liquid crystal display portion is obtained by providing the latter with a circular arrangement of display elements such that seconds are displayed along a circle around the hands.

A thin and small sized watch of the type described can be provided by forming a bore throughout the liquid crystal display device and locating hand stems and/or at least part of the inner module in the throughbore.

A multi-function compound display watch may be obtained if the liquid crystal display device is designed to selectively provide analog display of seconds and other kinds of information.

Where the liquid crystal display device selectively displays seconds in an analog fashion and the time left, a timer function is provided with a simple construction. In this case, the time left can be recognized intuitively at a glance.

A commercially valuable world timepiece can be realized with a compound display watch of the invention by causing the liquid crystal display device to selectively indicate seconds in an analog fashion and the position of time zone, city name or the like of a world timepiece.

Furthermore, an analog display of seconds and a digital display of calendar information if provided both by the liquid crystal display device will afford a wristwatch with a perpetual calendar whose displays are well matched to each other.

Figure 27:
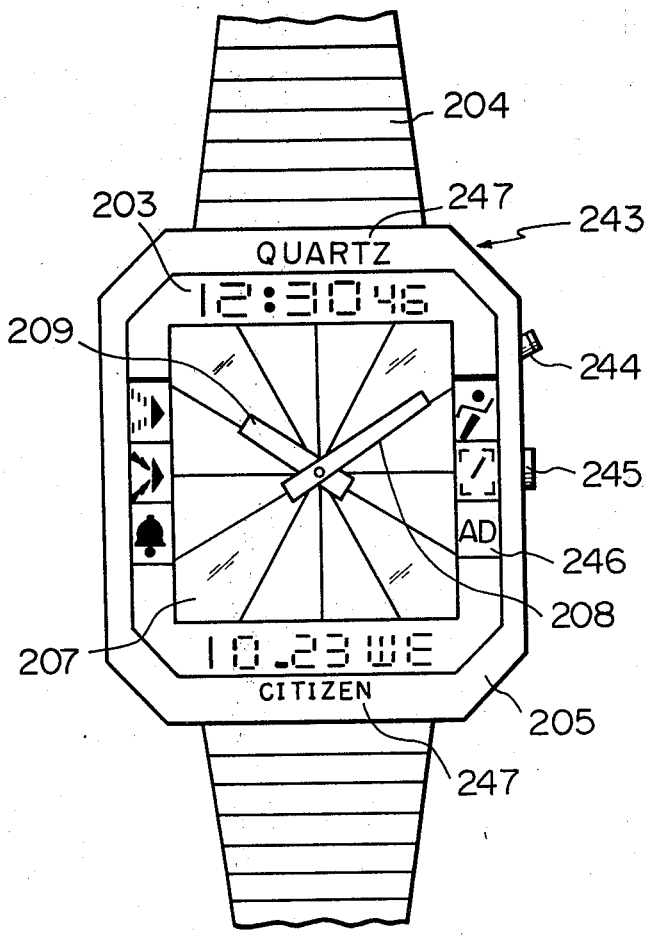
FIG. 27 is a plan view of another preferred embodiment of a composite display type electronic timepiece according to the present invention.
Figure 28A:
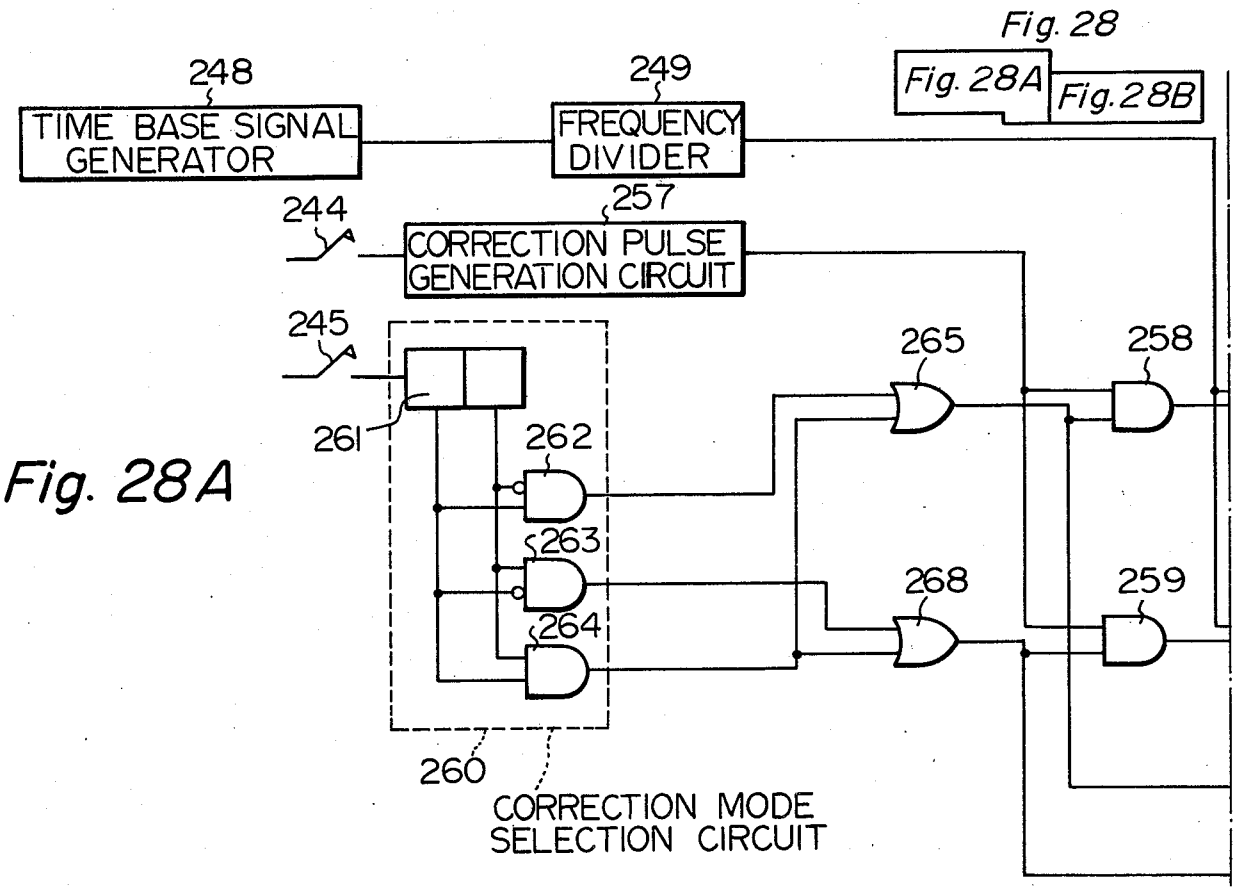
FIG. 28 is a circuit diagram of the timepiece of FIG. 27.
Figure 28B:
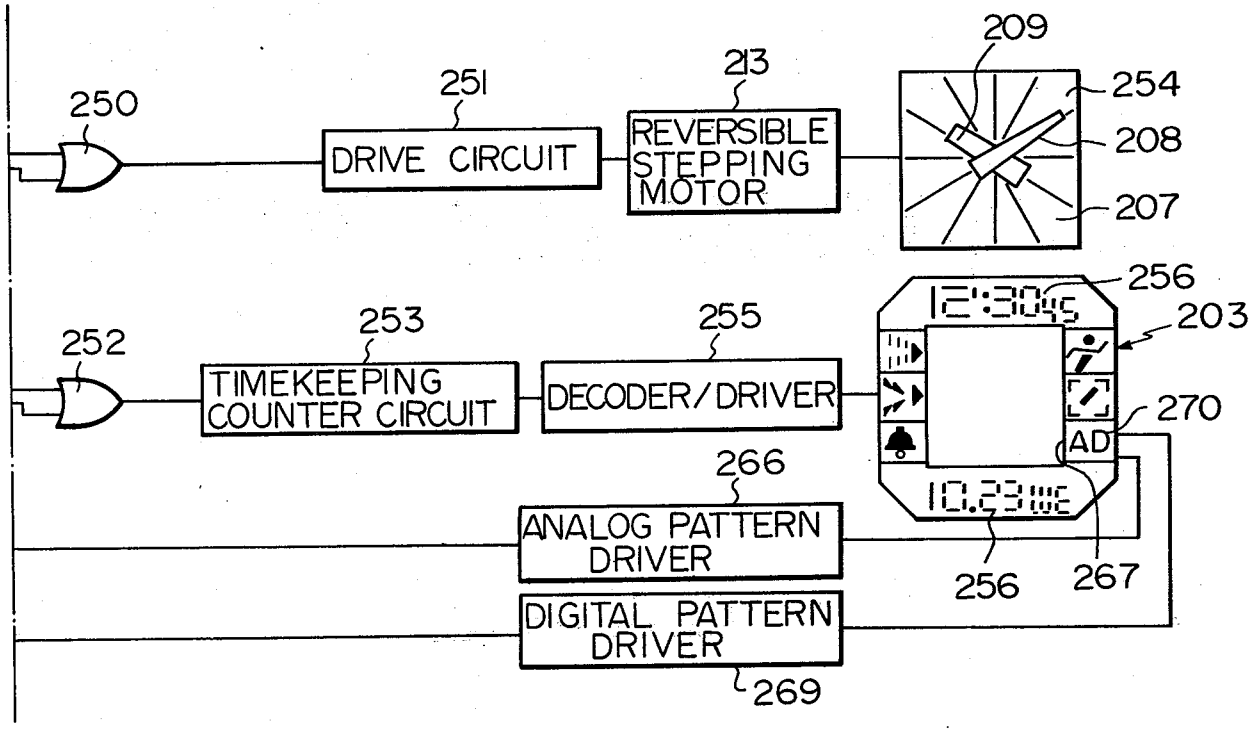

FIGS. 27 and 28 illustrate still another embodiment of the present invention which includes the provision of interlocking correction means which corrects the hands of the analog portion as well as the ring-shaped liquid crystal display cell in an interlocking manner, and independent correction means which corrects the analog and liquid crystal displays independently of one another, wherein the distinction between the interlocking and independent correction means is displayed by a correction mode display portion provided on a ring-shaped liquid crystal display cell. Specifically, FIG. 27 is a plan view of a dual display wristwatch having a correction mode display portion, and FIG. 28 a block diagram of the timepiece system.

Referring now to FIG. 27, there is shown an external view of a wristwatch designated generally at 243 which includes a watch band 204, outer case 205, switch 244, switch 245, display surface 207, long hand 208, short hand 209, ring-shaped liquid crystal display cell 203, and a correction mode display portion 246. Outer case 205 has characters 247 engraved therein and also serves as a decorative member for concealing the portion that provides the connection between the ring-shaped liquid crystal cell 203 and the timekeeping circuitry, which portion is not shown in FIG. 27.

In FIG. 28, a time base signal generator 248 which includes a quartz vibrator and delivers a time base signal to a frequency divider circuit 249 which divides the time base signal down to a time unit signal that is applied to a stepping motor drive circuit 251 through an OR gate 250 and to a timekeeping counter circuit 253 through an OR gate 252. Reversible stepping motor 213 is driven by stepping motor drive circuit 251 at a rate of one step per minute and actuates an analog display device 254 comprising a wheel train coupled to the stepping motor 213, the time-indicating hands 208 and 209, a dial 207, etc., whereby hours and minutes are displayed by the long and short hands 208 and 209 in analog fashion. Meanwhile, the content in counter circuit 253 is displayed digitally on the digital display portion of ring-shaped liquid crystal display cell 203 by means of a decoder/driver 255.

In accordance with this arrangement, if the time displayed by the analog display device 254 and the timekeeping content of timekeeping counter circuit 253 are brought into coincidence once, thereafter the state of coincidence will be maintained automatically thereafter so that the analog and digital displays are always in agreement. On the other hand, if a certain difference is established between the time displayed by analog display device 254 and the timekeeping content of counter 253, the set difference will be maintained automatically thereafter, so that the analog and digital displays will display two different times and can be utilized to provide a dual time capability or the like.

Switch 244 and a correction pulse generating circuit 257 generates a correction pulse operable to correct the displayed time. The output of circuit 257 is coupled to stepping motor drive circuit 251 through AND gate 258 and OR gate 250, and to timekeeping counter circuit 253 through AND gate 259 and OR gate 252. Switch 245 and a correction mode selection circuit 260 are provided to permit a selection between two correction modes, one for correcting analog display device 254 and ring-shaped liquid crystal display cell 203 in an interlocking manner, and the other for correcting these displays independently of one another. Correction mode selection circuit 260 is composed of a two-stage flip-flop 261 and gates 262, 263, 264, and delivers an analog correction mode signal from gate 262 when the two-stage flip-flop 261 provides a trugh value of "10" owing to a first operation of switch 245, the analog correction mode signal being sent to analog pattern driver 266 through OR gate 265, thereby to effect the display of a letter, such as the letter A, on the analog pattern display portion 267 of the ring-shaped liquid crystal display cell 203. On the other hand, if switch 245 is operated one more time, the truth value of two-stage flip-flop 261 becomes "01", so that now a digital correction mode signal is delivered from gate 263. This signal is sent to digital pattern driver 269 through OR gate 268 and effects the display of a letter, such as the letter D, on the digital pattern display portion 270 of the ring-shaped liquid crystal display cell 203. Operating switch 245 still one more time changes the truth value of flip-flop 61 to "11", with the result that an analog/digital correction mode signal is delivered from AND gate 264. This signal is sent to both the analog pattern driver 266 and digital pattern driver 669 through OR gates 265, 268 and effects the display of both letters A and D on the analog and digital pattern display portions 267, 270. Finally, one more operation of switch 245 changes the truth value of flip-flop 261 to "00", thereby inhibiting the production of a correction mode signal. Hence, neither of the letters A, D is displayed.

When the letter A is being displayed because of the "10" logic provided by flip-flop 261, operating switch 244 supplies the correction pulse and the analog correction mode signal to AND gate 258, and only the time displayed by the analog display device 254 is corrected. When the letter D is being displayed because of the "01" logic provided by flip-flop 261, operating switch 244 supplies the correction pulse and the digital correction mode signal to AND gate 259, and only the time displayed by the ring-shaped liquid. crystal display cell is corrected. When both letters A and D are being displayed because of the "11" logic provided by flip-flop 261, operating switch 244 supplies the correction pulse and the analog correction mode signal to AND gate 258, and the correction pulse and digital correction mode signal to AND gate 259, thereby allowing a simultaneous correction of the time displayed by both the analog display device 254 and ring-shaped liquid crystal display cell 203. When neither A nor D is displayed because of the "00" logic provided by flip-flop 261, operating switch 244 produces the correction pulse but the delivery of the analog and digital correction mode signals is inhibited. As a result, neither the analog display device 254 nor the liquid crystal display cell 203 is subjected to a time correction.

In FIG. 27, switch 244 is an ordinary push-button type switch, while switch 245 is a concealed push-button type switch. Depressing switch 245 selects the correction mode which can be confirmed by observing the analog pattern display portion 267 and digital pattern display portion 270. The time correction is effected by depressing switch 244.

Figure 29:
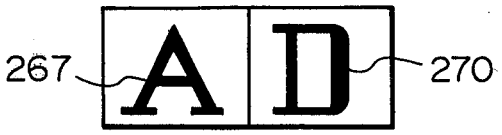
FIG. 29 is a diagram useful in describing the display patterns of a letter A and a letter D in the timepiece shown in FIG. 27.
Figure 30:
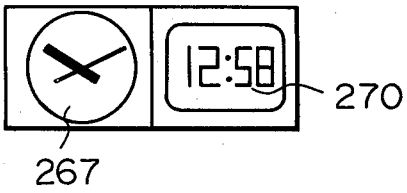
FIG. 30 is a diagram useful in describing a combined display pattern of an analog and digital timepiece.

Shown in FIG. 29 is an example of the A and D displays on the analog pattern display portion 267 and digital pattern display portion 270. FIG. 30 shows another example in which an analog clock pattern is displayed on the analog pattern display portion 267 and a digital clock pattern on the digital pattern display portion 270. This arrangement is suitable for use in countries in which the Roman alphabet is not employed and is therefore convenient for export since it permits the analog and digit correction modes to be distinguished from each other at a glance even in such countries. It is also possible with the present invention to adopt a system in which the correction pulses are produced by rotating a crown which can be utilized in place of a push-button type switch, or a system in which the displayed time can be advanced rapidly by holding a switch depressed. The analog and digital pattern display portions can also be made to flash.

Thus in a dual display timepiece of the type which displays horological information by time-indicating hands and a liquid crystal display cell, the liquid crystal display cell is rendered into a ring-shaped configuration, all or a portion of such components as an electromechanical transducer (such as a stepping motor), a gear train, time-indicating hands and their supporting shafts and a dial are accommodated in an empty space defined by the inner circumference of the ring-shaped display cell, a portion which provides a connection to timekeeping integrated circuitry is disposed on the outer side of the ring-shaped display cell, and decorative members such as the dial or a display cell cover plate are disposed over the connection portion, thereby making it possible to provide a display fully up to the inner circumferential portion of the ring-shaped liquid crystal display cell. Disposing the decorative members such as the dial or cover plate over the connection portion allows the compatibility and harmony of the analog and liquid crystal display portions to be improved, and contributes to the realization of a dual display timepiece possessed of a slim design.

Moreover, disposing the connection portion on both the inner and outer sides of the ring-shaped liquid crystal display cell and disposing the decorative members such as the dial and cover plate over the connection portion not only improves the compatibility and harmony of the analog and liquid crystal display portions and reduces timepiece thickness, but also contributes to the realization of a dual display timepiece having a multiplicity of elements and functions.

Still further, in a dual display timepiece of the type which displays horological information by time-indicating hands and a liquid crystal display cell, and having a correction switch for correcting time and other information, the liquid crystal display cell is rendered into a ring-shaped configuration, all or a portion of such components as an electromechanical transducer (such as a stepping motor), a gear train, time-indicating hands and their supporting shafts and a dial are accommodated in an empty space defined by the inner circumference of the ring-shaped display cell, a portion which provides a connection to time-keeping circuitry is disposed on a portion of the ring-shaped liquid crystal display cell, decorative members such as the dial or a display cell cover plate are disposed over the connection portion, the correction switch has interlocking correction means for correcting the time-indicating hands and the display cell in an interlocking manner and independent correction means for correcting the time-indicating hands and display cell independently of one another, and the ring-shaped liquid crystal display cell is provided with a correction mode display portion that furnishes a display which allows the interlocking correction means and independent correction means to be distinguished from one another, thereby allowing the compatibility and harmony of the analog and liquid crystal display portions to be improved, while also making it possible to recognize clearly which of the two types of displays is to be corrected, or whether both of the displays are to be corrected simultaneously. Such a construction affords a dual display timepiece which is extremely slim.

The foregoing embodiments have been illustrated and described in connection with dials and cell cover plates which are separate entities. However, it is obvious that thin film techniques such as printing and evaporation techniques can be employed to form these on the upper surface of the upper glass plate of the ring-shaped liquid crystal display cell.

The effects of the present invention, as may be understood from the foregoing description, are to be seen in the realization of a dual display timepiece which has improved compatibility and harmony between the time-indicating hands and liquid crystal display, a thinner design, and an easily recognizable correction mode.

What is claimed is:

1. An electronic timepiece comprising, in combination:

time indicating hands for providing a display of at least hours and minutes of time information;

an electro-optical display cell having a central aperture and a group of display elements arranged in a ring configuration around said time indicating hands to provide a display of data other than said time information; and an analog module including drive shafts extending through said central aperture of said electro-optical display cell and drivably connected to said time indicating hands to drive said time indicating hands, in which said analog module comprises a supporting plate serving as a circuit substrate having its one surface formed with a printed circuit pattern, and electrically conductive rubber means disposed between said electro-optical display cell and said circuit substrate to provide an electrical connection between said display cell and said printed circuit pattern;

at least a portion of said analog module being accommodated in the central aperture of said electro-optical display cell.

2. An electronic timepiece comprising, in combination:

time indicating hands for providing a display of at least hours and minutes of time information;

an electro-optical display cell having a central aperture and a group of display elements arranged in a ring configuration around said time indicating hands to provide a display of data other than said time information; and an analog module including drive shafts extending through said central aperture of said electro-optical display cell and drivably connected to said time indicating hands to drive said time indicating hands, in which said analog module also comprises a time dial which is partially disposed in the central aperture of said electro-optical display cell;

at least a portion of said analog module being accommodated in the central aperture of said electro-optical display cell.

3. An electronic timepiece comprising, in combination:

time indicating hands for providing a display of at least hours and minutes of time information;

an electro-optical display cell having a central aperture and a group of display elements arranged in a ring configuration around said time indicating hands to provide a display of data other than said time information, in which said electro-optical display cell has a digital display portion; and an analog module including drive shafts extending through said central aperture of said electro-optical display cell and drivably connected to said time indicating hands to drive said time indicating hands;

at least a portion of said analog module being accommodated in the central aperture of said electro-optical display cell.

4. An electronic timepiece comprising, in combination:

time indicating hands for providing a display of at least hours and minutes of time information;

an electro-optical display cell having a central aperture and a group of display elements arranged in a ring configuration around said time indicating hands to provide a display of data other than said time information;

an analog module including drive shafts extending through said central aperture of said electro-optical display cell and drivably connected to said time indicating hands to drive said time indicating hands; and a masking plate disposed over said electro-optical display cell;

at least a portion of said analog module being accommodated in the central aperture of said electro-optical display cell.

5. An electronic timepiece comprising, in combination:

time indicating hands for providing a display of at least hours and minutes of time information;

an electro-optical display cell having a central aperture and a group of display elements arranged in a ring configuration around said time indicating hands to provide a display of data other than said time information;

an analog module including drive shafts extending through said central aperture of said electro-optical display cell and drivably connected to said time indicating hands to drive said time indicating hands; and a masking plate disposed over said electro-optical display cell, in which said masking plate has a plurality of zone names;

at least a portion of said analog module being accommodated in the central aperture of said electro-optical display cell.

6. An electronic timepiece powered by a battery, comprising:

a quartz crystal oscillator providing a timebase signal;

a frequency divider dividing the frequency of said timebase signal to provide a low frequency time unit signal;

counter means responsive to said time unit signal for providing a time information signal including at least a seconds signal;

first driver circuit means responsive to said time information signal for providing a first drive signal;

a liquid crystal electro-optical display cell having a central aperture and a plurality of display elements arranged in a ring configuration, being responsive to said first drive signal for providing a display of seconds data;

second driver circuit means responsive to said time unit signal for providing a second drive signal; and an analog module comprising an electro-mechanical transducer responsive to said second drive signal for rotating at a predetermined rate, a gear train driven by said electro-mechanical transducer, and time indicating hands driven by said gear train to provide a display of at least hours and minutes;

at least a portion of said analog module being accommodated within said central aperture of said electro-optical display cell;

wherein said analog module and said electro-optical display cell are supported by a supporting plate serving as a circuit substrate having its one surface formed with a circuit pattern, and electrically conductive rubber means disposed between said electro-optical display cell and said circuit substrate to provide an electrical connection between said display cell and said circuit pattern.

7. An electronic timepiece powered by a battery, comprising:

a quartz crystal oscillator providing a timebase signal;

a frequency divider dividing the frequency of said timebase signal to provide a low frequency time unit signal;

counter means responsive to said time unit signal for providing a time information signal including at least a seconds signal;

first driving circuit means responsive to said time information signal for providing a first drive signal;

a liquid crystal electro-optical display cell having a central aperture and a plurality of display elements arranged in a ring configuration, being responsive to said first drive signal for providing a display of seconds data;

second driver circuit means responsive to said time unit signal for providing a second drive signal; and an analog module comprising an electro-mechanical transducer responsive to said second drive signal for rotating at a predetermined rate, a gear train driven by said electro-mechanical transducer, and time indicating hands driven by said gear train to provide a display of at least hours and minutes;

wherein said analog module also comprising a time dial which is partially disposed in the central aperture of said electro-optical display cell.

8. An electronic timepiece powered by a battery, comprising:

a quartz crystal oscillator providing a timebase signal;

a frequency divider dividing the frequency of said timebase signal to provide a low frequency time unit signal;

counter means responsive to said time unit signal for providing a time information signal including at least a seconds signal;

first driver circuit means responsive to said time information signal for providing a first drive signal;

a liquid crystal electro-optical display cell having a central aperture and a plurality of display elements arranged in a ring configuration, being responsive to said first drive signal for providing a display of seconds data;

second driver circuit means responsive to said time unit signal for providing a second drive signal; and an analog module comprising an electro-mechanical transducer responsive to said second drive signal for rotating at a predetermined rate, a gear train driven by said electro-mechanical transducer, and time indicating hands driven by said gear train to provide a display of at least hours and minutes;

at least a portion of said analog module being accommodated within said central aperture of said electro-optical display cell;

wherein said electro-optical display cell has a digital display portion.

9. An electronic timepiece powered by a battery, comprising:

a quartz crystal oscillator providing a timebase signal;

a frequency divider dividing the frequency of said timebase signal to provide a low frequency time unit signal;

counter means responsive to said time unit signal for providing a time information signal including at least a seconds signal;

first driver circuits means responsive to said time information signal for providing a first drive signal;

a liquid crystal electro-optical display cell having a central aperture and a plurality of display elements arranged in a ring configuration, being responsive to said first drive signal for providing a display of seconds data;

second driver circuit means responsive to said time unit signal for providing a second drive signal;

an analog module comprising an electro-mechanical transducer responsive to said second drive signal for rotating at a predetermined rate, a gear train driven by said electro-mechanical transducer, and time indicating hands driven by said gear train to provide a display of at least hours and minutes; and a masking plate disposed over said electro-optical display cell;

at least a portion of said analog module being accommodated within said central aperture of said electro-optical display cell.

10. An electronic timepiece according to claim 9, in which said masking plate has a plurality of zone names.

* * * * *